US006804982B2

(12) United States Patent
Garlaschi

(10) Patent No.: US 6,804,982 B2
(45) Date of Patent: Oct. 19, 2004

(54) DEVICE FOR THE EXTRACTION OF FORGED DETAILS, EXTRACTION UNIT COMPRISING THIS DEVICE AND THE MACHINE FOR THE PRODUCTION OF FORGED DETAILS

(75) Inventor: Eufemia Garlaschi, Milan (IT)

(73) Assignee: Carlo Salvi & C. S.r.l., Milan (IT)

( * ) Notice: Subject to any disclaimer, the term of this patent is extended or adjusted under 35 U.S.C. 154(b) by 52 days.

(21) Appl. No.: 10/187,520

(22) Filed: Jul. 1, 2002

(65) Prior Publication Data

US 2003/0000276 A1 Jan. 2, 2003

(30) Foreign Application Priority Data

Jul. 2, 2001 (IT) ..... MI2001A1403

(51) Int. Cl.[7] ..... B21J 13/14
(52) U.S. Cl. ..... 72/345; 470/152
(58) Field of Search ..... 72/344, 345; 470/152

(56) References Cited

U.S. PATENT DOCUMENTS

| | | | | |
|---|---|---|---|---|
| 3,266,071 A | * | 8/1966 | Nebendorf | 72/345 |
| 4,161,113 A | | 7/1979 | Kline | |
| 4,488,426 A | | 12/1984 | Wisebaker | |
| 4,538,437 A | * | 9/1985 | Wisebaker | 72/345 |

FOREIGN PATENT DOCUMENTS

| | | |
|---|---|---|
| EP | 0 950 447 A2 | 10/1998 |
| EP | 1 273 368 A2 | 6/2002 |
| GB | 674173 | 3/1950 |

* cited by examiner

*Primary Examiner*—Lowell A. Larson
(74) *Attorney, Agent, or Firm*—Abelman, Frayne & Schwab

(57) ABSTRACT

A device for the extraction of forged details (1) comprising a base (2) coupled with a forging head (3) supporting an extraction bar (4) of the forged details (11), a driving device (5), a command device (6) and an adjusting device of the extraction length (7) wherein said adjusting device (7) connects the extraction length with the length of the product to be extracted.

16 Claims, 4 Drawing Sheets

DEVICE FOR THE EXTRACTION OF FORGED DETAILS, EXTRACTION UNIT COMPRISING THIS DEVICE AND THE MACHINE FOR THE PRODUCTION OF FORGED DETAILS

The present invention refers to a device for the extraction of forged details.

More particularly, the present invention refers to a device for the extraction of forged details, particularly but not exclusively suitable to be used for the extraction of forged details from the matrix of machines for the production of said details.

As a second object, the present invention refers to an extraction unit comprising the device for the extraction of the forged details.

As a further object, the present invention refers to a machine for the production of said forged details.

It is known that, in a machine for the production of forged details, the length adjustment of the product shank and the adjustment of the extraction stroke of the device extracting the product after the forging are to be provided. These adjustments are independently carried out by very expensive chain kinematics motions which require long adjusting times and therefore they are expensive both for intervention and adjusting costs and for the relevant down-time.

The aim of the present invention is to provide a device for the extraction of forged details and solve the above-mentioned drawbacks.

According to the present invention, these and other aims will result from the following description and are obtained by a device for the extraction of forged details; a driving device; a command device and an adjusting device of the extraction length wherein said adjusting device connects the extraction length with the one of the product to be extracted.

Building and functional features of the device for the extraction of forged details of the present invention, will be better understood from the following description wherein reference is made to the figures of the enclosed drawings which represent a preferred and non limitative embodiment wherein.

Figure 1:
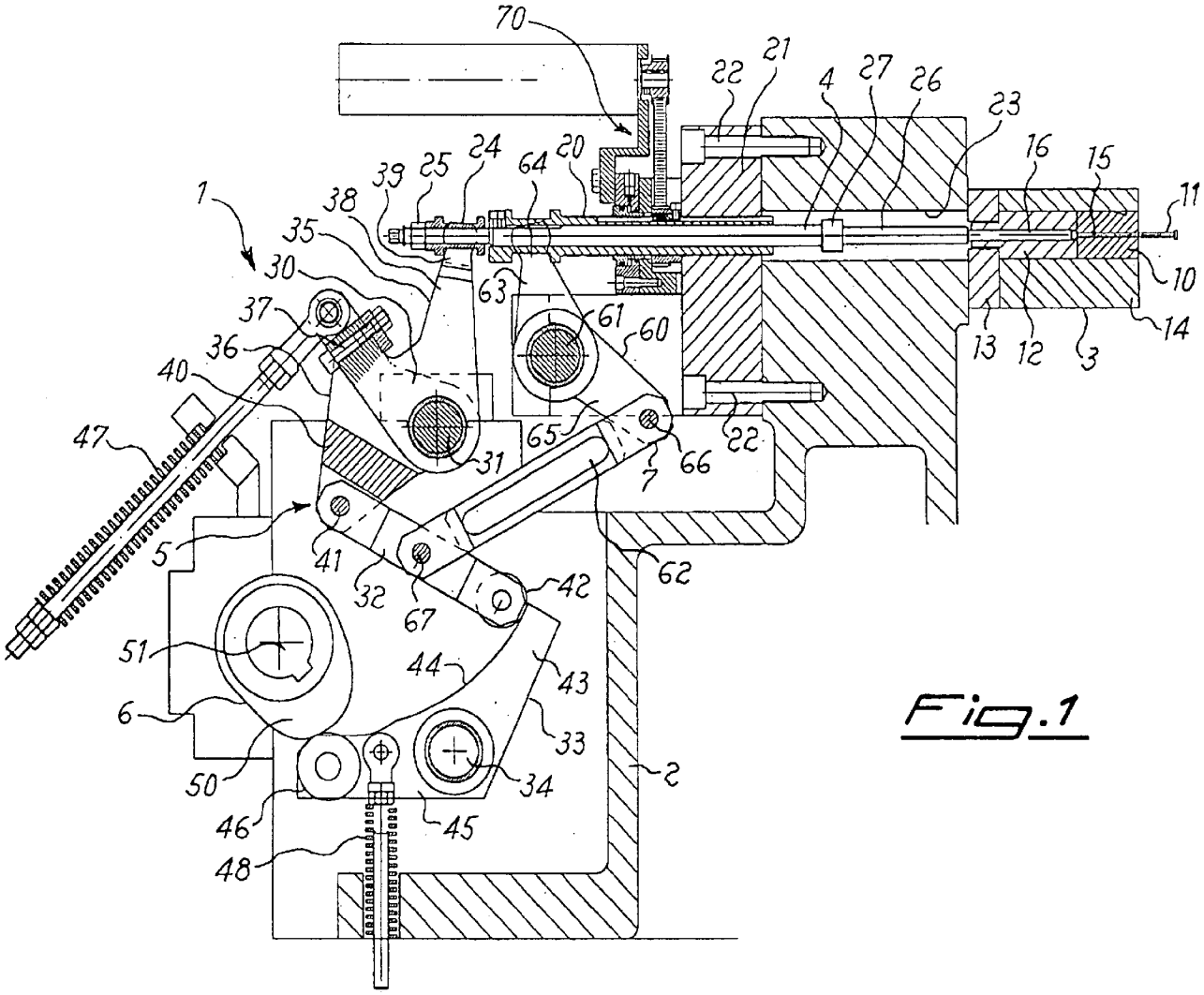
FIG. 1 is a section view of the device for the extraction of forged details of the present invention.

With reference to FIG. 1, the device for the extraction of forged details of the present invention marked as a whole with 1, comprises a base 2 coupled with a forging head 3 which supports an extraction bar 4 of the forged details, a driving device 5, a command device 6 and an adjusting device of the extraction length 7.

The forging head 3 which is coupled with the base 2, comprises a forging matrix 10 to forge, for example, a rivet 11, a thrust collar 12, a striker 13 and a support 14. The forging matrix 10 and the thrust collar 12 are respectively provided with an ejection pin 15 and a thrust pin 16 placed on the same axis which are already known and therefore they are not further described.

The extraction bar 4 is rod-shaped, preferably cylindrical and it slides inside a drilled screw 20 which is screwed on a support 21 fastened to the base 2 with screws 22 and opposite to the forging head 3.

The support 21 is fastened to the base 2 in such a way that the axis of the extraction bar 4 corresponds to the one of the thrust pin 16 and of the ejection pin 15.

The base 2 is provided with a pass-through hole 23 having a diameter which is higher than the external one of the drilled screw 20 and is coaxial both to the pins of the forging head 3 and to the extraction bar 4 in such a way that the latter is able to freely cross it.

On the end which is far from the forging head 3, the extraction bar 4 is provided with a double-headed nut 24 which is locked by a lock nut 25 and it is sized in such a way that its thrust end 26 can reach the coupling surface of the forging head 3 to the base 2.

The extraction bar 4 is finally provided with a collar 27 or thrust collar, which is placed on the thrust end 26 side at a distance from the end of the drilled screw 20 which is equal to the length of the detail to be produced and therefore equal to the extraction length.

The driving device 5 comprises a first rocker 30 which is rotatingly pivoted on the pivot 31, a tappet 32 and a second rocker 33 which is rotatingly pivoted on the pivot 34. The first rocker 30, in the embodiment described in this example, comprises a first lever 35 and a second lever 36 which are integral between them through a safety screw 37 in correspondence with the reciprocally opposite relevant arms. The second arm 38 of the first lever 35 has, at its end, a fork 39 which is operatively associated to the double-headed nut 24. A first end of the tappet 32 is rotatingly associated to the second arm 40 of the lever 36 through a pivot 41, this tappet 32 is provided with a roller 42 at the opposite end. The second rocker 33 has a first arm 43 which is abutted on the roller 42 of the tappet 32 through a cylindrical-shaped surface 44 having an axis parallel to the one of the pivot 34 and facing the tappet 32; while the second arm 45, at its end, is provided with a roller 46. The driving device 5 is completed by a first spring device 47 associated to the first rocker 30 and by a second spring device 48 associated to the second rocker 33 which is constantly acting on said driving device 5 in order to return to the rest state or at the beginning of the working cycle.

The command device 6 comprises a cam 50 which is splined on a shaft 51 which rotates in a suitable seat provided on the base 2.

The adjusting device of the extraction length 7 comprises a lever 60 which is rotatingly pivoted on the pivot 61 and a connecting rod 62. In the embodiment described in this example, a first arm 63 of the lever 60 has a fork 64 at its end which is operatively associated to the drilled screw 20 which, in its turn, has a proper seat for said fork 64. The connecting rod 62 is rotatingly associated, with one of its first ends, to the second arm 65 of the lever 60 through a pivot 66, while the opposite end is rotatingly associated to the tappet 32 through a pivot 67 substantially in the middle of the same tappet 32.

The adjusting device of the extraction length 7 has one command means.

Figure 2:
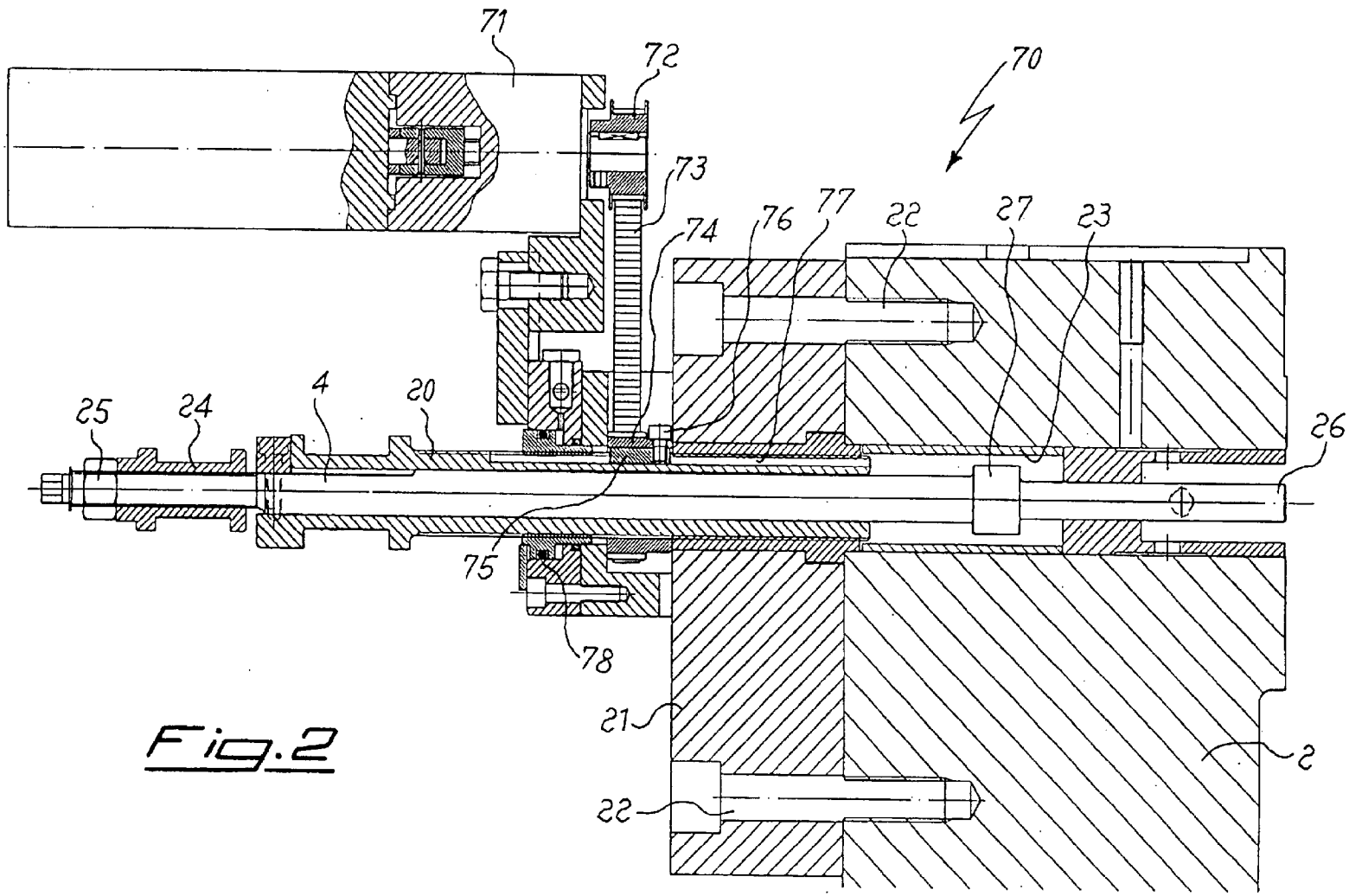
FIG. 2 is a section view of the command device of the adjusting device of the device for the extraction of forged details of FIG. 1.

With reference to FIG. 2, the one command means marked with 70 of the adjusting device of the extraction length 7, comprises an engine 71 which is equipped with a splined pinion 72 on its shaft, a drive or chain belt 73, preferably a toothed belt and a toothed wheel 74 which, in rotation, is coupled with the drilled screw 20. In this example the coupling between the toothed wheel 74 and the drilled screw 20 is carried out through a key 75, which is fastened to said toothed wheel 74 through a screw 76 which is engaged in a relevant groove 77 placed along a generating line of the external surface of said drilled screw 20; so that during a rotation the toothed wheel 74 and the drilled screw 20 can slide each other. Alternatively, the coupling between the toothed wheel 74 and the drilled screw 20 can be carried out by any other form locking suitable for this purpose. The only command means 70 is completed by a hydraulic nut 78 to lock the drilled screw 20 which is well known and therefore it is not further described.

The device for the extraction of forged details of the present invention operates as described here below.

During the operating phase, as shown, for example, in FIG. 1 where the device for the extraction of forged details 1 is shown during the phase of the end stroke of extraction, the adjusting device of the extraction length 7 is locked by the hydraulic nut 78 in the position which is expected for the current extraction length. In such a way, the drilled screw 20 is fixed and, consequently, also the lever 60 is kept fixed through the fork 64 of its arm 63.

The shaft 51 of the command device 6 rotates and keeps in rotation the cam 50 which, engaging the roller 46, makes the second rocker 33 rock at each turn. The second rocker 33, with its surface 44, pushes the tappet 32 which, in its turn, makes the first rocker 30 rock. The first rocker 30 pushes the extraction bar 4 making it slide in the drilled screw 20, through the fork 39 of its arm 38, which is operatively associated to the double-headed nut 24. The extraction bar 4, with its end 26, pushes the thrust pin 16 which, in its turn, pushes the ejection pin 15 so that the forged detail 11 is extracted from the matrix 10. At this moment, the cam 50 is at its utmost lift position. The device returns to the rest state or at the beginning of the cycle ready for the subsequent one continuing the rotation of the cam 50 and being stressed by the spring devices 47 and 48.

During the adjusting phase, the adjusting device of the extraction length 7 is unlocked by the unlocking of the hydraulic nut 78 so that the drilled screw 20 and, consequently, also the lever 60 can move.

In this state, the engine 71 through the belt 73 puts into rotation the toothed wheel 75 which, in its turn, makes the drilled screw 20 rotate which, during the rotation, translates along its axis. While translating, the drilled screw 20 drags the fork 64 of the arm 63 of the lever 60 to make it rotate. The lever 60 with its arm 65 acts on the connecting rod 62 which, in its turn, acts on the tappet 32. In such a way, the tappet 32 changes the contact point of the roller 42 along the surface 44 of the second rocker 33. The layout of the surface 44 is such that when the position of the roller 42 changes, a rotation of the first rocker 30 takes place together with a consequent movement of the extraction bar 4. In such a way, the stroke of the drilled screw 20 has been related to the one of the extraction bar 4; this relation is univocal so that at each movement of the drilled screw 20, a correspondent and predetermined movement of the extraction bar 4 takes place thus obtaining the automatic adjustment both of the detail and of the extraction length acting on one adjusting command means.

The proportioning of the components, not only connect the stroke of the drilled screw 20 with the one of the extraction bar 4, but it must also have the following features.

The curvature of the surface 44 of the second rocker 33 is such that the utmost reachable position of the extraction bar 4 must be constant when the extraction stroke changes.

The extraction stroke of the extraction bar 4, which corresponds to the length of the detail 11 to be extracted, is determined by the position of the collar or thrust collar 27 with respect to the end of the drilled screw 20.

Figure 3:
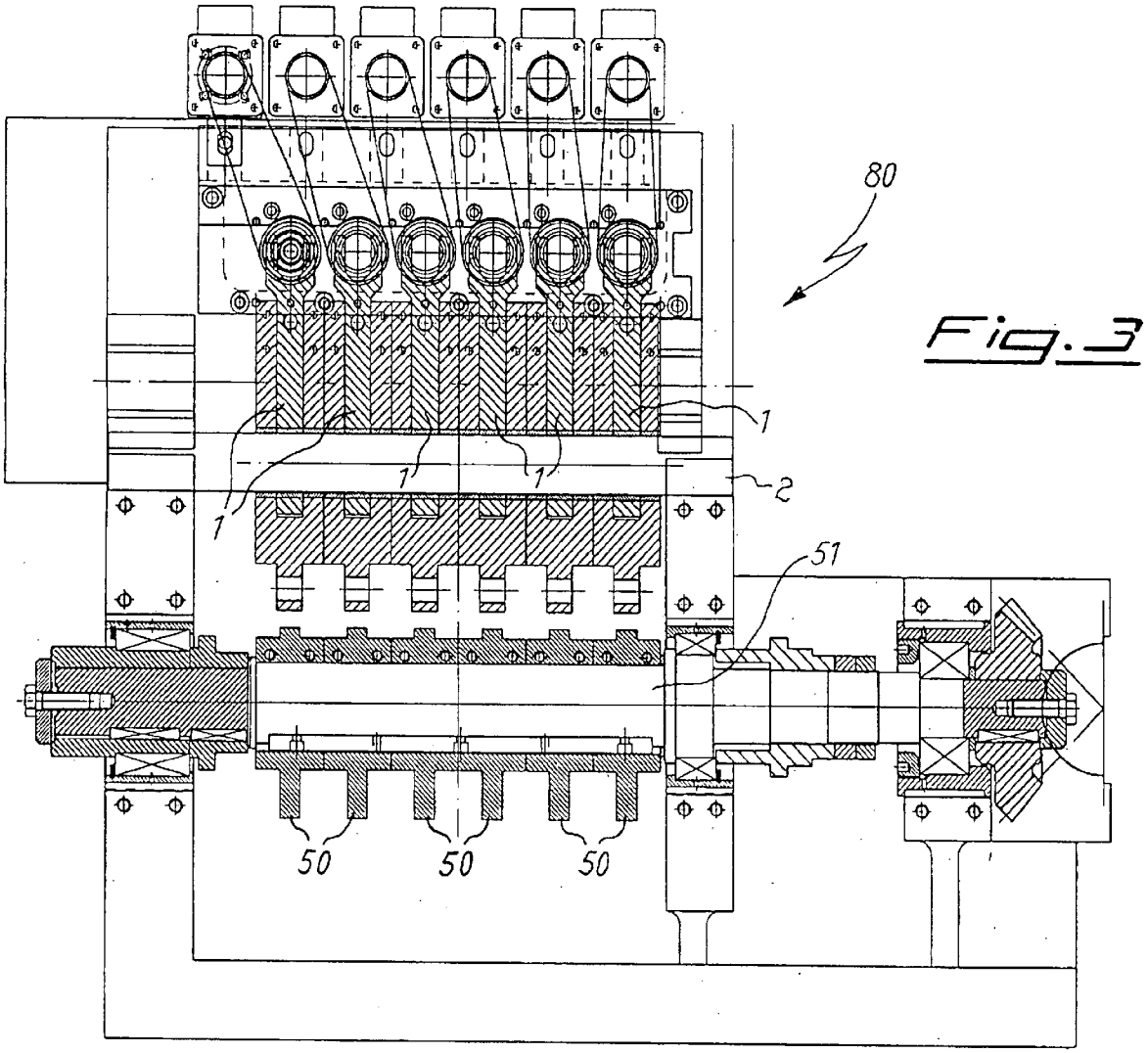
FIG. 3 is a section view of an extraction unit comprising the device for the extraction of forged details of FIG. 1.

With reference to FIG. 3, an extraction unit, as a whole, comprising the device to extract forged details according to the present invention is marked with 80. The extraction unit 80 comprises a plurality of devices for the extraction of forged details 1 placed side by side.

In the extraction unit 80, the individual cams 50 can be replaced by one cam and also the second rocker 33 of each single device can be replaced by one rocker; or in the one extraction device the adjusting command means can be replaced by a manual one.

Figure 4:
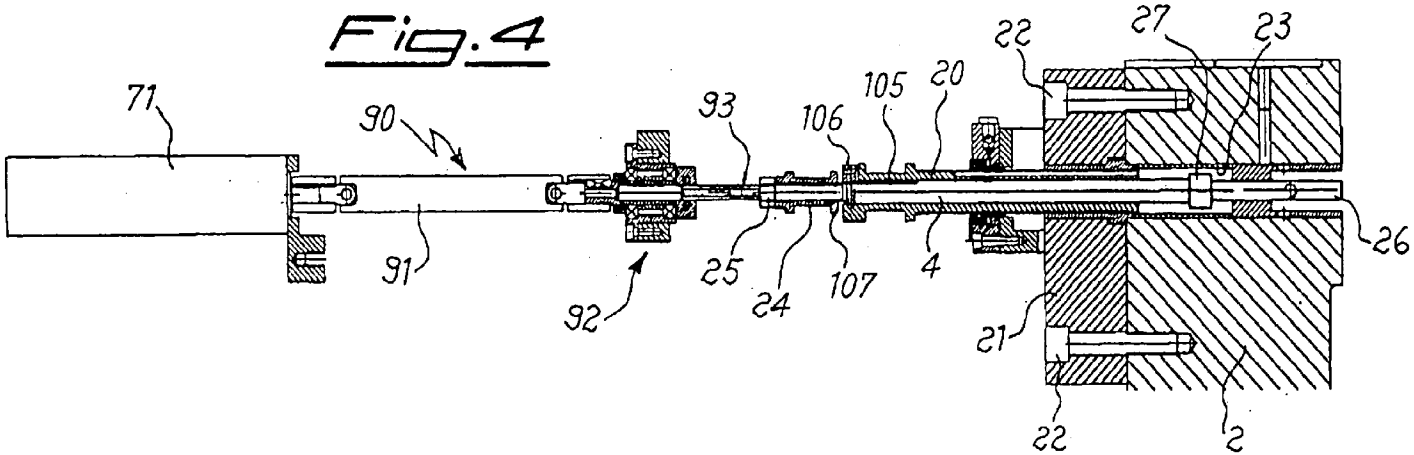
FIG. 4 is a section view of a different embodiment of the command device of the device for the extraction of forged details of FIG. 1.
Figure 5:
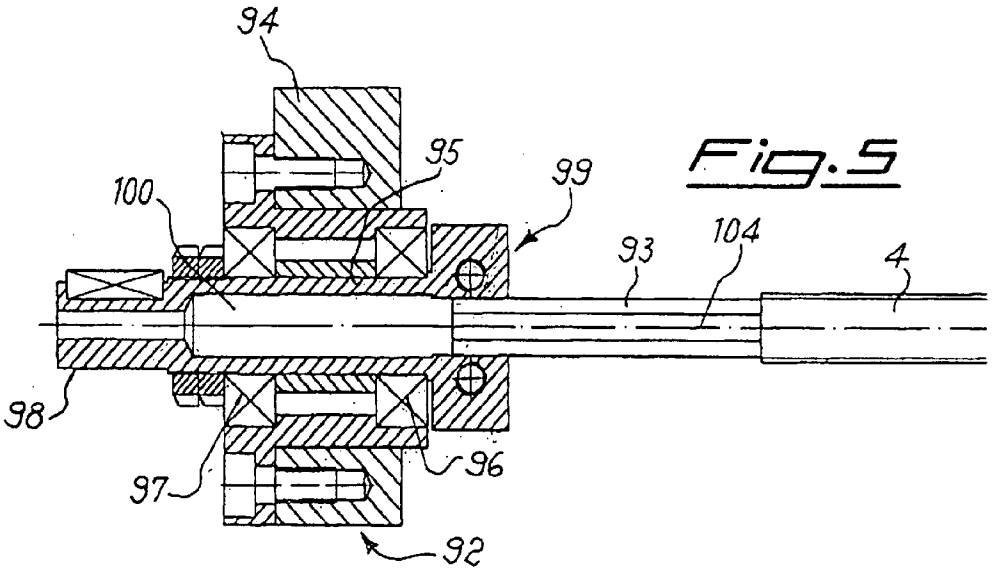
FIG. 5 is a section view of a component of the different embodiment of FIG. 4.
Figure 6:
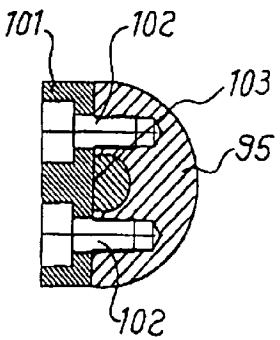
FIG. 6 is a section view according to the line VI—VI of FIG. 5.

FIGS. 4–6 show a different embodiment of the one command means of the adjusting device of the extraction length 7 which is marked with 90 comprising the engine 71, a universal joint 91 and a drive unit 92 coupled with an elongation 93 of the extraction bar 4. The drive unit 92 shown in FIG. 5, comprises a fixed support 94 which rotatingly houses a sleeve 95 through bearings 96 and 97. The sleeve 95 shows an end 98 which is suitable for the connection to the universal joint 91, while the opposite end is equipped with a form locking 99 suitable for the housing of the elongation 93 of the extraction bar 4. Moreover, the sleeve 95 has an axial drilling 100 which can house the elongation 93 of the extraction bar 4. As it is shown in FIG. 6, the form locking 99 is made by a block 101 fastened by screws 102 to the sleeve 95 in order to have a surface 103 facing the axis of the same sleeve.

The elongation 93 of the extraction bar 4 shows a surface 104 which is parallel to its axis in such a way to be coupled with the surface 103 of the form locking 99 of the sleeve 95.

The extraction bar 4 and the drilled screw 20 are integral in rotation through a form locking which is equal to the form locking 99; this form locking is carried out through a surface 105 on the same extraction bar 4 and a block 106 which is fastened through screws 107 to said drilled screw 20.

The adjustment of the adjustment device of the length 7 takes place with the same procedure previously described. From the previous description it is clear that the device for the extraction of forged details of the present invention allows an optimum adjustment of the extraction length, together with a great building and operating simplicity, thus solving the drawbacks mentioned in the known art.

Obviously, a technician skilled in the art, can introduce changes and variations or combinations of variations to the above described extraction device to extract the forged details. All these changes, variations or combinations of variations are contained in the field of the present invention as stated by the following claims.

What is claimed is:

1. An extracting device (1) for a forging machine for extracting forged details, said forging machine having a base (2), a command device (6) comprising a cam (50) splined or a shaft (51) supported by said base (2), and a forging head (3) supporting an extraction bar (4) for extracting the forged details (1), said extracting bar (4) sliding inside a drilled screw (20) fastened to said base (2) in a position opposite to said forging head (3), having a first axis coincident with a second axis of the forging head (3) and being provided with a double-headed nut (24) and with a thrust collar (27), said extracting device comprising:

a first rocker (32) pivotally connected to said base (2) and having a first rocker lever (35) and a second rocker lever (36), said first rocker lever (35) being operatively associated with said double-headed nut (24);

a tappet (32) having a first end and an opposite second end, said first end being rotatingly associated with the second rocker lever (36) of said first rocker (30);

a second rocker (33) pivotally connected to said base (2), having a first rocker arm (43) with a cylindrical surface (44) facing the tappet (32), and having a second rocker arm (45) in following contact with said cam (50) and the second end of the tappet (32) cooperating with said cylindrical surface (44);

a pivoting lever (60) pivotally connected to said base (2) and having a first lever arm (63) and a second lever arm (65), said first lever arm (63) being operatively associated with said drilled screw (20);

a connecting rod (62) having a first end rotatingly associated with said second lever arm (65) of said pivoting lever (60), and having a second opposite end rotatingly associated with a middle portion of said tappet (32); and a motor (71), operatively connected to said drilled screw (20) and moving said drilled screw (20) along a longitudinal axis of the drilled screw (20) in rectilinear motion, with said rectilinear motion of the drilled screw (20), through said pivoting lever (60) and said connecting rod (62), causing a change of a contact point of the second end of the tappet (32) along the cylindrical surface (44) of the second rocker (33) and the rotation of the first rocker (30) with a consequent movement of the extraction bar (4), correlating a screw stroke of the drilled screw (20) to an extraction stroke of the extraction bar (4).

2. The extracting device (1) according to claim 1, wherein a curvature of the cylindrica surface (44) determines a constant utmost position reachable by the extraction bar (4) when the extraction stroke changes.

3. The extracting device (1) according to claim 2, wherein the extraction stroke of the extraction bar (4) is determined by a position of the thrust collar (27) with respect to an end of the drilled screw (20).

4. The extracting device (1) according to claim 1, wherein the extraction stroke of the extraction bar (4) is determined by a position of the thrust collar (27) with respect to an end of the drilled screw (20).

5. The extracting device (1) according to claim 1, further comprising:

a first spring (47) connected to the first rocker (30) and operating a return action of said first rocker (30).

6. The extracting device (1) according to claim 1, further comprising:

a second spring (48) connected to the second rocker (33) and operating a return action of said second rocker (33) against an action of the cam (50).

7. The extraction device (1) for the extraction of forged details according to claim 1, wherein the second spring device (48) associated to the second rocker (33) operates to return at the beginning of a cycle of the screw stoke and the extraction stroke.

8. The extraction device (1) for the extraction of forged details according to claim 1, wherein the cam (50) which is splined on the shaft (51) rotates in a seat provided on the base (2).

9. The extraction device (1) for the extraction of forged details according to claim 1, wherein the engine (71) is equipped with a pinion (72), a belt (73), a toothed wheel (74) which is coupled in rotation with the drilled screw (20), and a hydraulic nut (78) for the locking of the drilled screw (20).

10. The extraction device (1) for the extraction of forged details according to claim 1, further comprising:

a universal joint (91) and a drive unit (92) coupled with an elongation (93) of said extraction bar (4).

11. An extraction unit (80) comprising the extraction device (1) for the extraction of forged details according to claim 1.

12. A machine for the production of forged details comprising the extraction unit (80) according to claim 11.

13. A machine for the production of forged details comprising the extraction device (1) for the extraction of forged details according to claim 1.

14. The extraction device (1) for the extraction of forged details according to claim 1, wherein the extraction stroke of the extraction bar (4), corresponding to the extraction length of the detail (11) to be extracted, is determined by a position of the thrust collar (27) with respect to an end of the drilled screw (20).

15. The extraction device (1) for the extraction of forged details according to claim 1, wherein the extraction bar (4) is cylindrical and rod-shaped to slide inside the drilled screw (20); and wherein the double-headed nut (24) is locked by a lock nut (25).

16. The extraction device (1) for the extraction of forged details according to claim 1, wherein the tappet (32) is rotatingly associated with the first rocker (30) and abutted on the cylindrical surface (44) of the second rocker (33);

a third axis of the cylindrical surface (44) is provided parallel to a fourth axis of a pivot (34); and the second rocker arm (45) provided with a roller (46) at its end.

* * * * *